US007946905B2

(12) United States Patent
Thomas

(10) Patent No.: US 7,946,905 B2
(45) Date of Patent: May 24, 2011

(54) BIT SHARPENING APPARATUS AND METHOD OF USING

(76) Inventor: Charles M Thomas, Wilson, WY (US)

( * ) Notice: Subject to any disclaimer, the term of this patent is extended or adjusted under 35 U.S.C. 154(b) by 0 days.

(21) Appl. No.: 12/286,852

(22) Filed: Oct. 2, 2008

(65) Prior Publication Data

US 2009/0124170 A1 May 14, 2009

Related U.S. Application Data

(63) Continuation-in-part of application No. 11/291,443, filed on Dec. 1, 2005, now Pat. No. 7,510,458.

(60) Provisional application No. 60/633,404, filed on Dec. 4, 2004.

(51) Int. Cl.
*B24B 49/12* (2006.01)

(52) U.S. Cl. ..... 451/6; 451/374

(58) Field of Classification Search ..... 451/6, 367, 451/374, 380, 279, 293
See application file for complete search history.

(56) References Cited

U.S. PATENT DOCUMENTS

| | | | | |
|---|---|---|---|---|
| 1,079,420 | A | 11/1913 | MacKay | |
| 2,729,923 | A | 1/1956 | Durst | |
| 3,149,444 | A | 9/1964 | Schneider | |
| 3,683,564 | A | 8/1972 | Lawrence | |
| 3,828,486 | A | 8/1974 | Bonke | |
| 3,952,616 | A | 4/1976 | Varley | |
| 4,370,834 | A * | 2/1983 | Habib | 451/6 |
| 5,582,542 | A | 12/1996 | Steain | |
| 5,649,853 | A | 7/1997 | Kuo | |
| 5,727,991 | A | 3/1998 | Main | |
| 5,816,898 | A | 10/1998 | Wirth et al. | |
| 6,030,276 | A * | 2/2000 | Mortell et al. | 451/5 |
| 6,234,881 | B1 | 5/2001 | Martin, Jr. | |
| 6,283,830 | B1 | 9/2001 | Kuo | |
| 6,287,177 | B1 | 9/2001 | Shaffer | |
| 6,676,495 | B1 | 1/2004 | Siemers et al. | |
| 6,808,440 | B2 | 10/2004 | Mundt | |
| 6,811,362 | B2 | 11/2004 | Wallin et al. | |
| 6,942,551 | B2 | 9/2005 | Mizek et al. | |
| 7,312,861 | B2 * | 12/2007 | Loen | 356/138 |

* cited by examiner

*Primary Examiner* — Robert Rose

(57) ABSTRACT

Disclosed in the present application is a sharpening apparatus and method for sharpening a cutting bit. The apparatus comprises a sharpening member and a laser for accurately positioning the cutting bit surface to be sharpened with respect to the sharpening member. The apparatus and method are particularly useful for sharpening a router or shaper bit.

Also disclosed is a sharpening apparatus for a cutting bit having a flat face comprising grinding wheel having a shaft and a flat annular grinding surface perpendicular to said shaft; a bit holder adapted to hold said cutting bit and to orient the bit flat face into a plane that is parallel to the plane of the grinding wheel grinding surface; a carriage supporting the bit holder; advancing means for advancing said carriage in a motion parallel to the grinding wheel shaft so that the bit is against the grinding wheel grinding surface; means for side-to-side movement of said carriage in a motion perpendicular to the grinding wheel shaft; said advancing means further comprising a gear train for further advancing the bit flat face against the grinding wheel grinding surface in small increments to remove small layers of material from said bit cutting face during said side-to-side movement.

12 Claims, 5 Drawing Sheets

BIT SHARPENING APPARATUS AND METHOD OF USING

RELATED APPLICATIONS

This application claims the benefit of Provisional U.S. Patent Application Ser. No. 60/633,404 filed Dec. 4, 2004 and Utility U.S. patent application Ser. No. 11/291,443 filed Dec. 1, 2005, both entitled Bit Sharpening Apparatus and Method of Using. The benefit of the earlier filing dates of the aforementioned applications Ser. No. 60/633,404 and Ser. No. 11/291,443 are hereby claimed. The disclosures in the aforementioned applications Ser. No. 60/633,404 and Ser. No. 11/291,443 are hereby incorporated herein in their entirety by this reference thereto.

BACKGROUND OF THE INVENTION

1. Technical Field

The present invention relates to a new and improved apparatus and method for sharpening tool bits, particularly a carbide router or shaper bit.

2. Brief Description of the Prior Art

Routers and shapers have become two of the most important tools in a Woodworker's shop. A router and shaper bit sharpening device must meet three criteria to be desirable to professional and non-professional sharpeners. It must be inexpensive, easy to use, and effective. No conventional sharpener has achieved these goals. Professional grinding equipment can cost up to five hundred thousand dollars. Inexpensive devices are difficult to use and ineffective.

Router and shaper bits have multiple blades attached to the shaft of the bit at roughly right angles to the shaft. To use any router bit sharpening device, each blade has to be sharpened individually. To sharpen each blade, the face of the blade must first be made parallel to the face of a grinding wheel. With conventional sharpeners, this is achieved by coloring the face of the blade, attempting to align the blade by eye, and then swiping the blade with the grinding wheel to check if it is parallel. Inevitably it must be readjusted several times and even then it is never quite right. With small router or shaper bits, this alignment is all but impossible. The small bits have so little surface area on the face of the blade that it is difficult to make the blade parallel to the face of a grinding wheel.

In addition, the hook and rake angle of each blade with respect to the bit shaft are usually different, due to the way the bits are made. Because of the difficulty of aligning a blade to the face of the grinding wheel, the person doing the sharpening makes only the first adjustment relying on that for all of the blades. This means that generally only the first blade is parallel to the grinding wheel. Subsequent blades end up wedge shaped when sharpened. As a result one blade is higher that the rest and does all of the cutting. The cut is not as clean and the bit becomes dull very quickly. Further, the sharpener may remove more material from each blade than is necessary in the effort to sharpen all of the blades, making future sharpening impossible.

Existing router bit sharpeners are designed to bring the bit into contact with the face of a grinding wheel by sliding the bit holder, during sharpening, in a direction perpendicular to the grinding wheel shaft. Any minute play in the sharpening machine or the grinding wheel results in a rounding over of the front edge of the router bit blade. While very high quality sharpeners have minimal play, the rounding over of the front edge of the bit is still a problem, particularly when disengaging the bit from a grinding wheel. The rounding over is much more acute with less expensive machines.

The prior art is illustrated in prior U.S. Pat. No. 5,816,898. The device of the patent is used with a grinding wheel mounted in a drill press. Referring in particular to FIG. 4 of the patent, a sharpening device is shown comprising a head 18 mounted on a head support 62. The head 18 supports a chuck 16 into which a bit is inserted. The bit is rotated in the chuck until the leading edge of the bit is generally parallel to the drill press table, and the bit is tightened in the chuck. This is a coarse adjustment for the hook angle of the bit. The adjusting screw 72 is then turned to adjust the shear angle of the bit bringing the face of the bit into a plane generally parallel to the face of the grinding wheel. The drill press is lowered until the drill press is directly over the bit to determine how parallel the face of the bit is to the grinding wheel. This adjustment process is repeated if necessary. The grinding wheel is turned on. The bit is brought in until the cutting face touches the wheel. The bit is then slid back and forth with the cutting face under the grinding wheel in a motion perpendicular to the grinding wheel shaft until sharpening is completed.

Any play in the system, inconsistencies in the table top, in the wheel, the drill press, or any other component of the apparatus, is translated to the critical point of contact between the bit cutting face and the edge of the grinding wheel resulting in rounding of the front edge of the bit.

It is an object of the present invention to provide a bit sharpening apparatus that is easier to use and achieves better quality sharpening.

It is further an object of the present invention to provide a bit sharpening apparatus or machine that minimizes the effects of play or inconsistencies in the machine. This decreases the tolerances to which the machine needs to be built allowing manufacture of the machine at a more reasonable cost affordable to small woodworkers and nonprofessional sharpeners.

BRIEF DESCRIPTION OF THE PRESENT INVENTION

The apparatus of the present invention is for sharpening cutting bits. The sharpening apparatus comprises a sharpening member and a laser for accurately positioning the cutting bit surface to be sharpened with respect to the sharpening member.

The present invention also resides in method for sharpening a cutting bit using a sharpening apparatus comprising the step of using a laser beam to accurately position the cutting bit surface to be sharpened with respect to the sharpening apparatus.

The apparatus and method of the present invention are particularly useful for sharpening a router or shaper bit, particularly one having a plurality of blades, each blade having a carbide flat face.

In a preferred embodiment, the sharpening apparatus comprises a grinding wheel having a shaft and a flat annular grinding surface perpendicular to said shaft; a bit holder adapted to hold said cutting bit and to orient the bit flat face into a plane that is parallel to the plane of the grinding wheel grinding surface; a carriage supporting the bit holder; advancing means for advancing said carriage in a motion parallel to the grinding wheel shaft so that the bit is against the grinding wheel grinding surface; means for side-to-side movement of said carriage in a motion perpendicular to the grinding wheel shaft; said advancing means further comprising a gear train for further advancing the bit flat face against the grinding wheel grinding surface in small increments to remove small layers of material from said bit cutting face during said side-to-side movement.

Preferably the bit holder comprises a tool holder, the bit being rotatable in the tool holder to position the bit flat face in a plane that has the same orientation with respect to the vertical as the grinding surface of the grinding wheel, and a tool post supporting the tool holder, the tool post being able to rotate about an axis parallel to the grinding surface of the grinding wheel to position the bit flat face in a plane that is parallel to the grinding surface of the grinding wheel.

In a method according to the present invention, a router or shaper bit is first positioned in a bit holder. A mirror is attached to the face of the bit and a laser beam parallel to a grinding wheel shaft is bounced off the mirror. The bit is rotated in its holder until the laser beam engages a horizontal line drawn through the laser beam's point of origin, indicating the blade has the same orientation with respect to the vertical as the face of the grinding wheel. The tool holder is then rotated about an axis that is parallel to the plane of the grinding wheel face until the laser beam engages a vertical line drawn through the laser beam's point of origin indicating that the blade is in a plane that is parallel to the grinding face of the grinding wheel The bit holder is then advanced to move the bit cutting face into and against the grinding wheel face in a motion that is parallel to the grinding wheel shaft.

BRIEF DESCRIPTION OF THE DRAWINGS

The invention and advantages thereof will become more apparent from the following detailed description of the present invention with reference to the accompanying drawings, in which.

DETAILED DESCRIPTION OF THE PRESENT INVENTION

Figure 1:
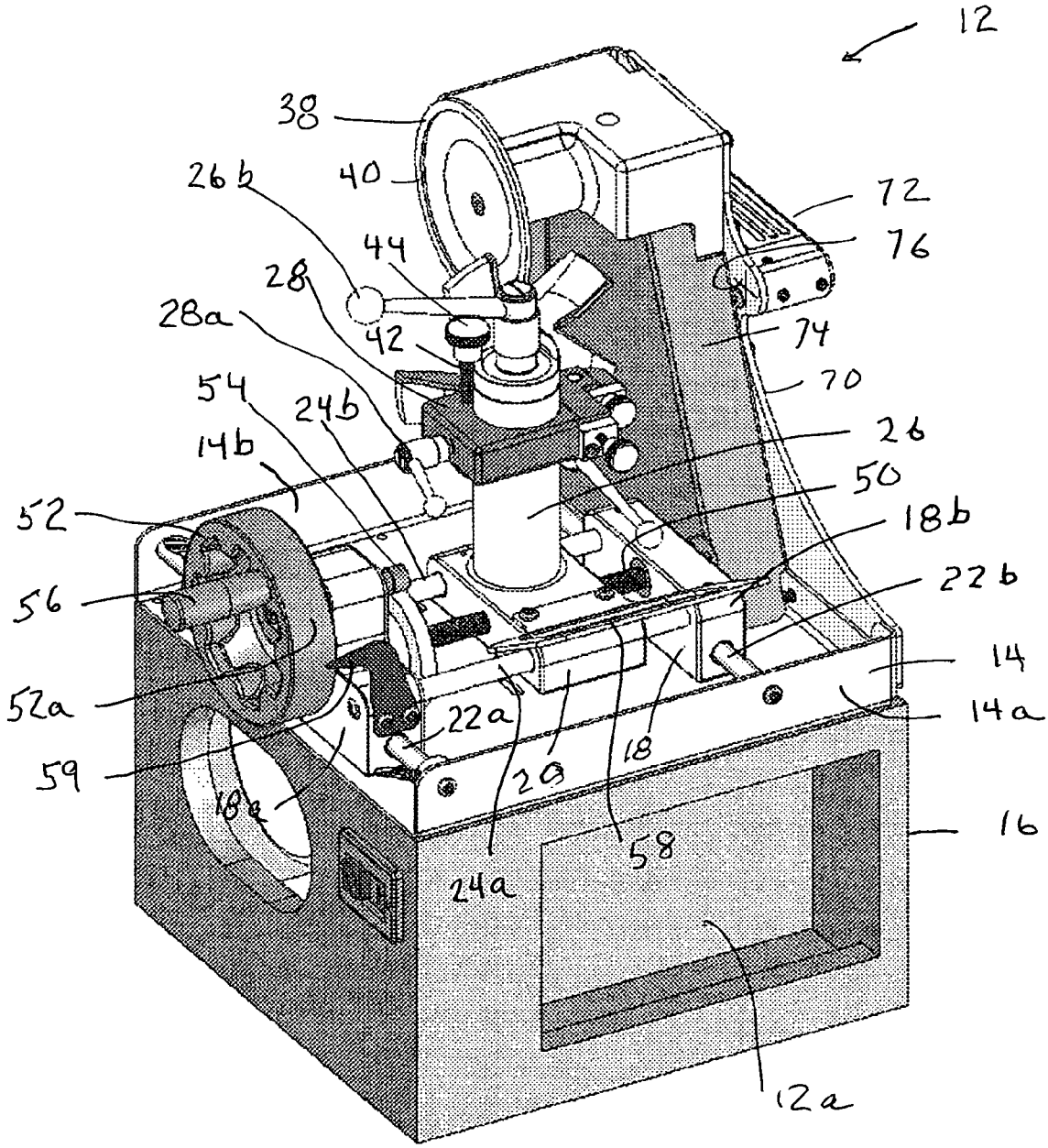
FIG. 1 is a front perspective view of a cutting bit sharpening apparatus in accordance with the present invention.

The cutting bit sharpening apparatus of the present invention is shown in front perspective view of FIG. 1. The sharpener 12 comprises a base 14. The base sits upon a motor housing 16. Carriage 18 is supported on the base 14, and the carriage 18 supports a tool post support 20. The front of the sharpener is side 12*a*.

Supporting rods 22*a* and 22*b* for carriage 18 extend front to back between flanges 14*a* and 14*b* of the base 14. The carriage 18 comprises two spaced-apart blocks 18*a* and 18*b*. The blocks 18*a* and 18*b* move from front to back on the supporting rods 22*a* and 22*b*. The carriage 18 is confined to front and back movement, with respect to the base 14 by the rods 22*a* and 22*b*. The carriage blocks 18*a* and 18*b* slide on roller bearings (not shown) that engage the rods 22*a* and 22*b*. All components of the carriage 18 and the rods 22*a* and 22*b* are machined with minimum tolerances to avoid play in the component parts.

The tool post support 20 moves from side to side relative to the front 12*a* on spaced-apart supporting rods 24*a* and 24*b*. The rods 24*a* and 24*b* are supported by and extend between the side adjustment carriage blocks 18*a* and 18*b*. The tool post support rods 24*a* and 24*b* are at right angels to the carriage rods 22*a* and 22*b*. The side-to-side movement of the tool post support 20 is at right angles to the front-to-back movement of the carriage 18. As with the carriage 18, all components of the tool post support 20 and the tool post support rods 24*a* and 24*b* are machined with minimum tolerances to avoid play in the component parts.

The tool post support 20 supports tool post 26 that is mounted vertically on the tool post support 20. The tool post 26 is mounted on the tool post support 20 so that it can be rotated on the support 20.

A tool holder 28 is supported by the tool post 26. The tool holder 28 can be raised and lowered vertically on the tool post 26 in a manner to be described. Once in the desired vertical position, the tool holder 28 is clamped into place on the tool post 26 by quick release clamp 28*a* that locks the tool holder 28 onto the tool post 26.

Figure 3:
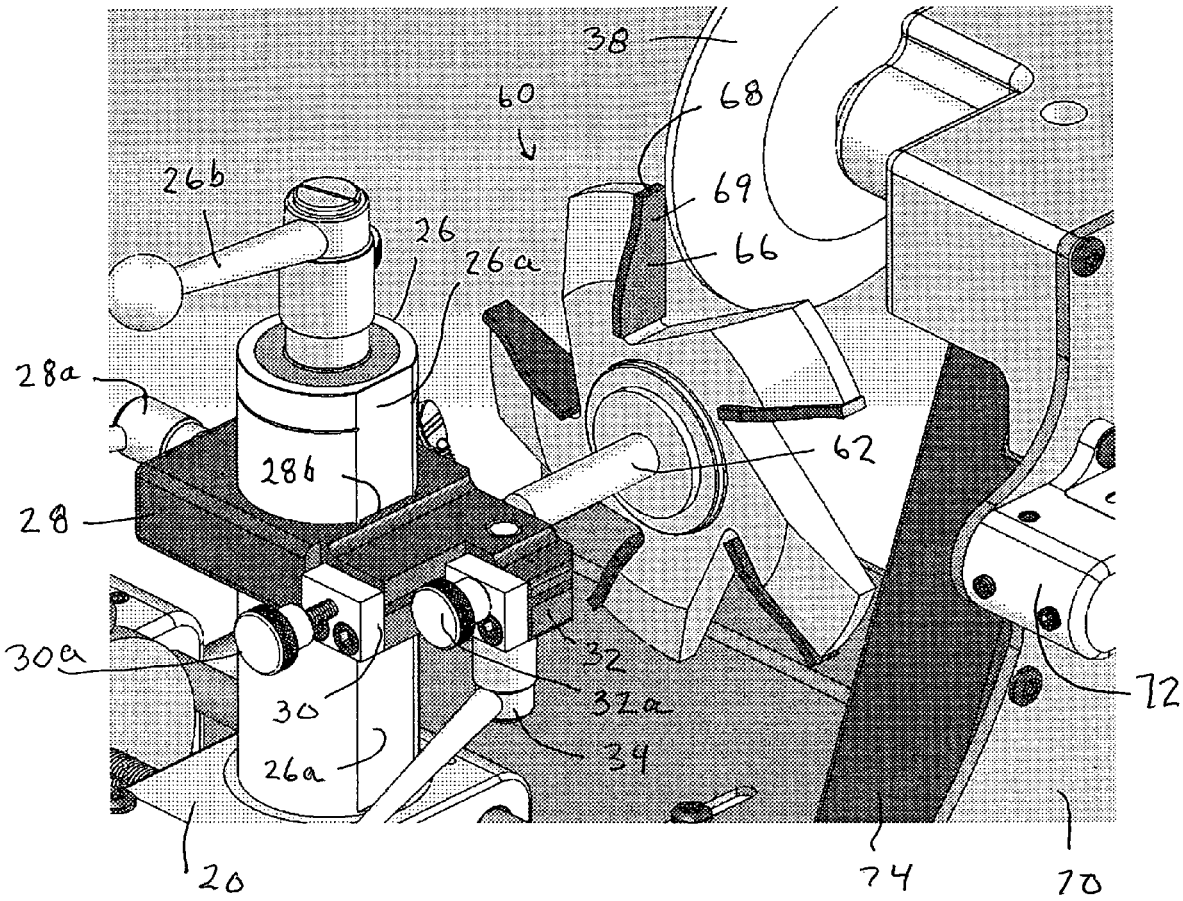
FIG. 3 is an enlarged perspective view of a portion of the apparatus of FIG. 1.

Referring to FIG. 3, the tool post 26 has a flat side 26*a* that extends vertically on the back side of the tool post. The tool holder 28 has a flat surface 28*b* that engages the flat side 26*a* of the tool post. The engaged flat surfaces 26*a* and 28*b* prevent the tool holder 28 from rotating on the tool post 26.

Above it was mentioned that the tool post 26 is rotatably mounted on the tool post support 20. This allows the tool holder 28 and the post 26 to be turned by hand relative to the support 20. When turned so that it is in the desired orientation, it can be readily clamped into place using quick release clamp 26*b* on the top of the tool post.

Still referring to FIG. 3, the tool holder 28 comprises two holder members 30 and 32. Router bits come with ¼ inch and ½ inch shanks. Inner holder member 30 is for a ½ inch shank bit and outer holder member 32 is for a ¼ inch shank bit. Each holder member has an adjustable stop, stops 30*a* and 32*a*. The holder members 30 and 32 are positioned on the side of the tool holder 28 so that the bit shanks extend tangentially in a direction perpendicular to the axis of the tool post 26. Quick release clamp 34 clamps a bit to be sharpened when placed in either holder member 30 or holder member 32.

Figure 2:
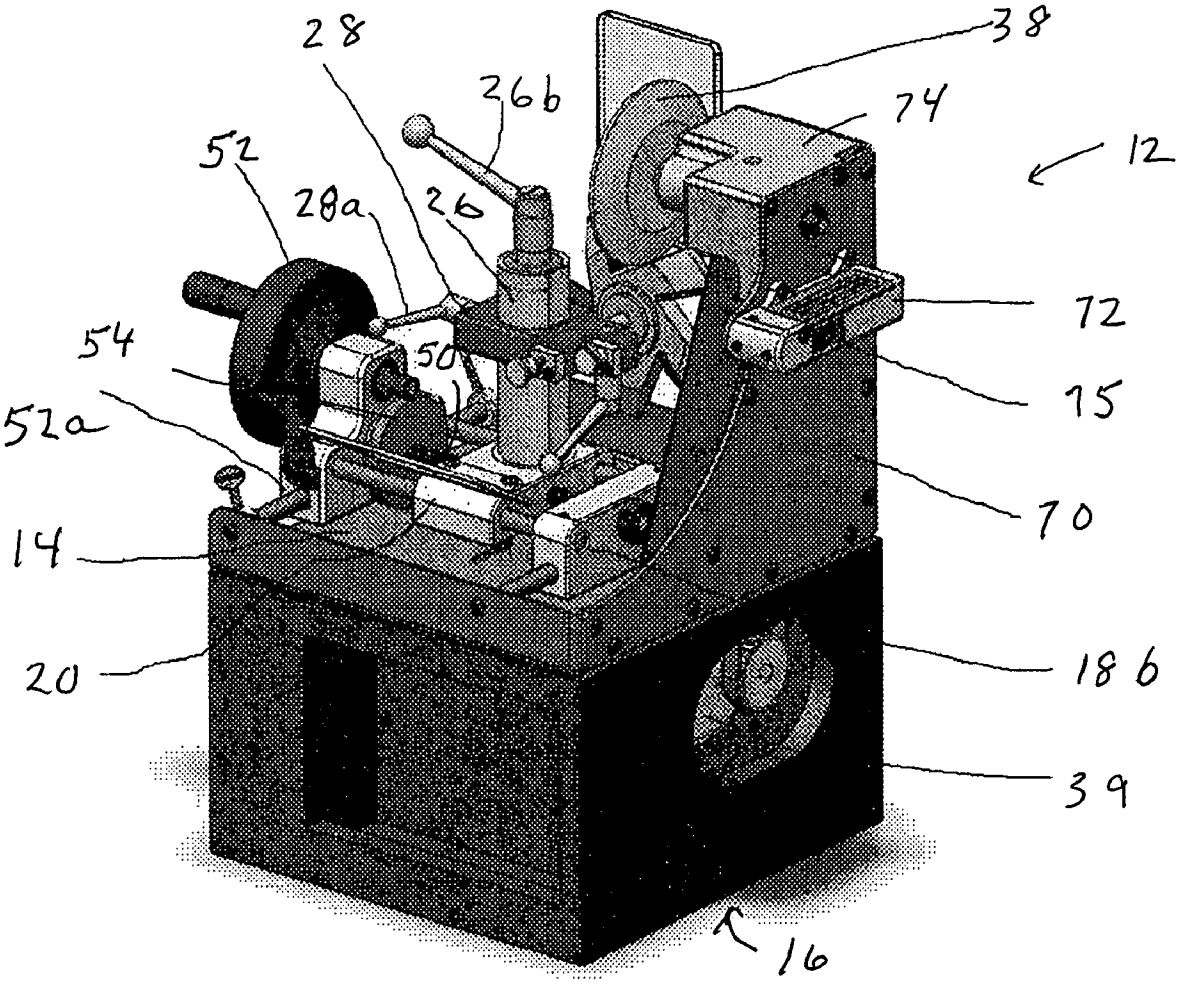
FIG. 2 is a perspective view showing details of the right side of the apparatus of FIG. 1.

Referring to FIG. 2, the bit sharpener 12 also comprises a flat grinding wheel 38. The grinding wheel 38 is driven by a motor 39 within the motor housing 16. The grinding wheel 38 has a flat, raised, annular, diamond, abrasive, grinding face 40 (FIGS. 1 and 4) on the front side of the wheel 38. The annular raised face 40 is narrow, for instance about one quarter inch wide as the diamond grit is expensive. In the present invention, a very fine grinding wheel face is used, for instance a 400 grit wheel. Conventional grinders that rely on movement of the bit in a direction perpendicular to the grinding wheel shaft also rely on the removal of a relatively large amount of material, and generally use coarser wheels, for instance a 120 grit wheel. In the present invention, the removal of large amounts of material is not necessary.

Figure 4:
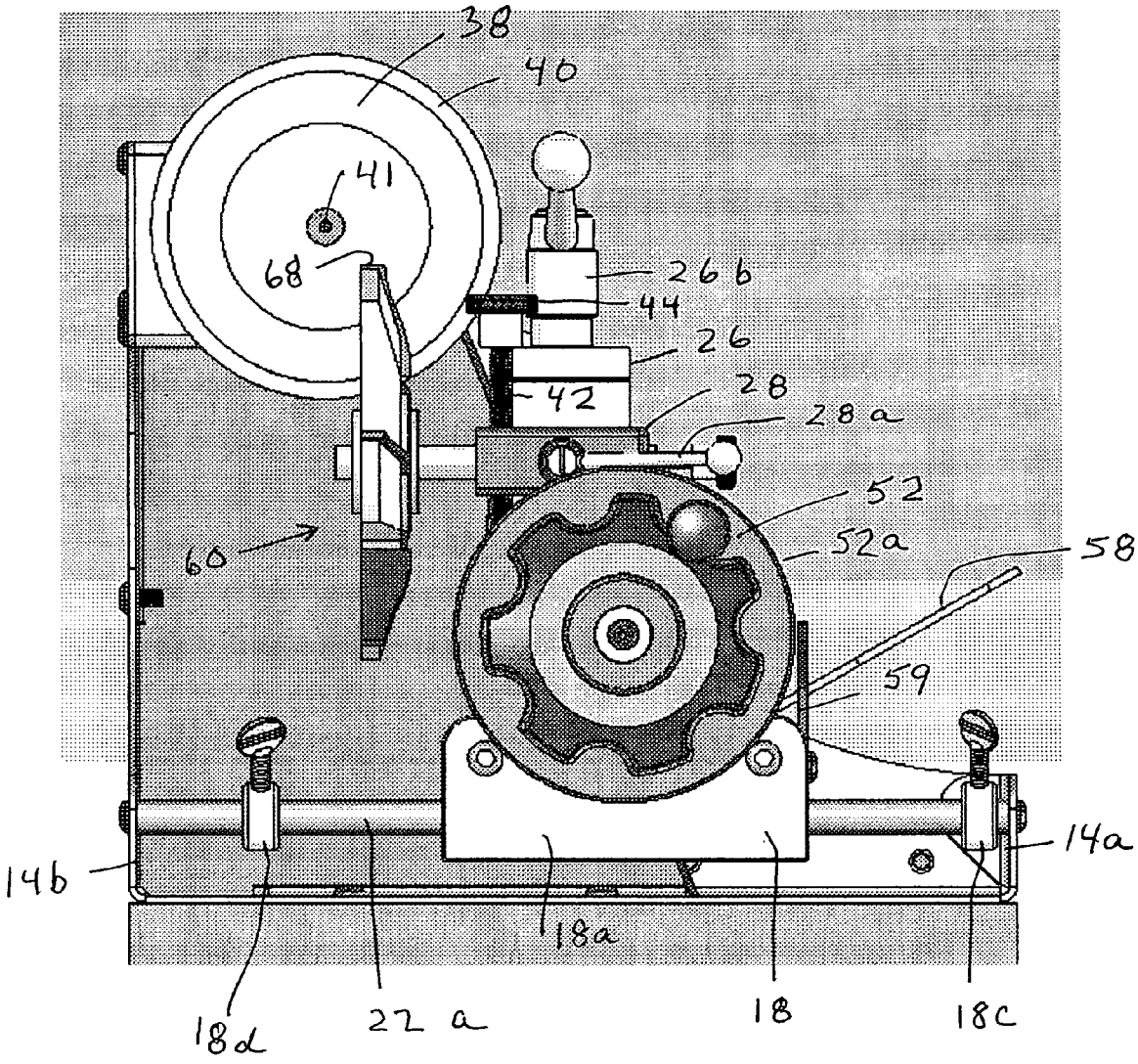
FIG. 4 is a elevation view showing details of the left side of the apparatus of FIG. 1.

Above it was mentioned that the tool holder 28 is vertically movable up and down on the tool post 26. This is accomplished using a tool holder adjusting screw 42 (FIG. 1) positioned on one side of the tool post 26 (as shown in FIGS. 1 and 4). The adjusting screw 42 is parallel to the axis of the tool post 26 and is threaded through the tool holder 28. A knurled knob 44 is affixed to the top of the adjusting screw 42. The vertical height or position of the tool holder 28 relative to the grinding wheel 38 is fine tuned by turning the knurled knob 44. Again, once at the desired height, the tool holder 28 is clamped into place using quick release clamp 28*a*.

The tool post support 20 is moved on the tool post support rods 24*a* and 24*b* into and away from the grinding wheel 38 by threaded screw 50 (FIGS. 1 and 2) that extends through the tool post support 20 and is parallel to and centered between the tool post support rods 24*a* and 24*b*.The side-to-side adjustment (relative to the front 12*a* of the sharpener) of the tool post support 20 is by careful adjustment of dial 52 (FIGS. 1 and 4). The dial 52 engages the threaded screw 50 (FIG. 1) through a gear train 54. As with other components of the sharpener, the gear train and threaded screw 50 are carefully machined to minimize play. The dial 52 has lines (not shown) drawn on its rim 52*a* used to aid in incrementally moving the bit 60 toward the grinding wheel 38. Turning the dial 52, with the aid of indicator 59, moves the tool post support 20 towards or away from the grinding wheel 38. The gear train 54 between the dial 52 and the threaded screw 50 is such that a turn of the dial 52 causes only an incremental movement of the tool post support towards or away from the grinding wheel 38. By way of example, the dial 52 can have multiple lines drawn on rim 52*a*, e.g., 24. Rotating the dial one line at a time advances the tool post support 20 only a small fraction of an inch, e.g., one quarter of one thousandth of an inch. Each full rotation of the dial may move the tool post support 20 still only a fraction of an ince, e.g., 0.01 inch. Still by way of example, sharpening of a blade surface may involve rotation of dial 52 one revolution.

The carriage 18 is moved manually from front-to-back (relative to front 12*a*) simply by grasping a handle 58 on the carriage 18 (see FIGS. 1 and 4) and sliding it on supporting carriage rods 22*a* and 22*b*. Stops 18*c* and 18*d* (FIG. 4) on carriage rod 22*a* confine the forward and backward movement of the carriage 18 to the positions of the stops.

Figure 5:
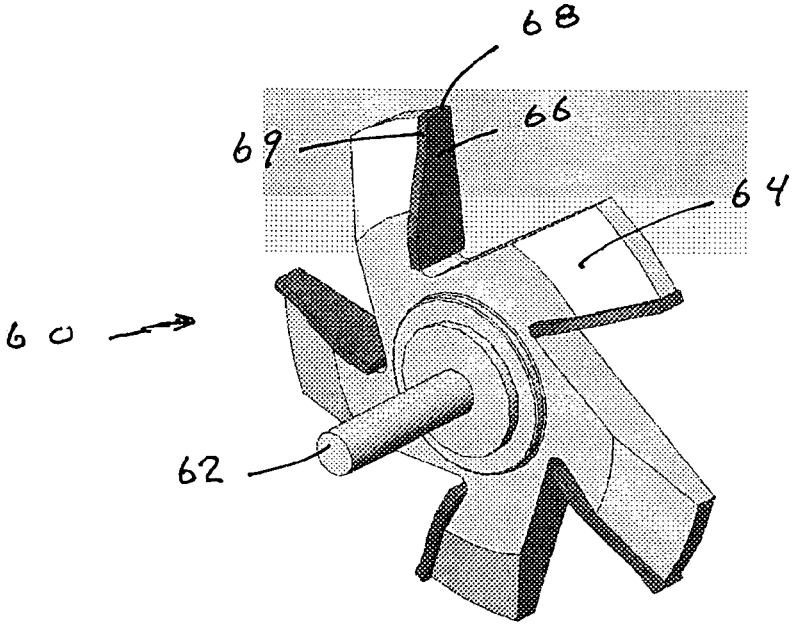
FIG. 5 is an enlarged perspective view of a router bit capable of being sharpened by the apparatus of FIG. 1.

Router bits, also referred to as shaper bits, are a somewhat recent development dating back to the mid-1900's. The bits are unique and very distinguishable from a conventional drill bit. An example of a router bit is shown in FIG. 5. The bit 60 has a cylindrical shank 62. Blades 64 extend tangentially outwardly from the shank 62. In the embodiment of FIG. 5, five blades 64 are shown. The bit can have only one blade, or two or three blades or more. The bit rotates in a counter-clockwise direction. Each blade 64 has a flat face 66. Each face 66 is at an angle "Y", of 90 degrees or less to a transverse section of the bit. The angle "Y" is known as the hook angle. The blade 64 (FIG. 5) also has a cutting edge 68. The cutting face 66 comprises a layer 69 of carbide steel, about one-eighth inch thick.

The cutting edge 68 of the bit 60, in the embodiment of FIG. 5, is contoured with a concave shape. The cutting edge 68 provides the wood with the contour of the edge 68 during the cutting process. Different router bits can have different contours depending upon the shape of the cut that is desired.

The cutting is a slicing action. To accomplish this, the blade face 66 is given an angle that deviates from the axis of the bit, angle "X". The angle "X" is known as the shear angle.

Regardless of the geometry of the router bit, the flat face 66 is the surface that is ground to sharpen the bit. In the sharpening process, a grinding wheel having a flat face is used, and the bit face 18 is ground against the grinding wheel flat face.

Because of the unique angles "X" and "Y" of the bit face 18, which vary from bit to bit depending on the use intended for the bit, and because of the small surface areas of the bit face 18, it is difficult to provide a machine which is capable of universal, easy and accurate orientation of the bit face 18.

In the present invention, the flat face 66 of the router bit 60 is aligned with the flat face 40 of a grinding wheel 38 by using a laser beam. This is illustrated in FIGS. 1, 2 and 3. Referring to FIG. 2, a mounting post 70 supports a laser 72. The post 70 is positioned on support 74 for the grinding wheel 38 so that the laser 72 is behind and slightly to one side of the grinding wheel 38. The laser has on/off switch 75.

Figure 6:
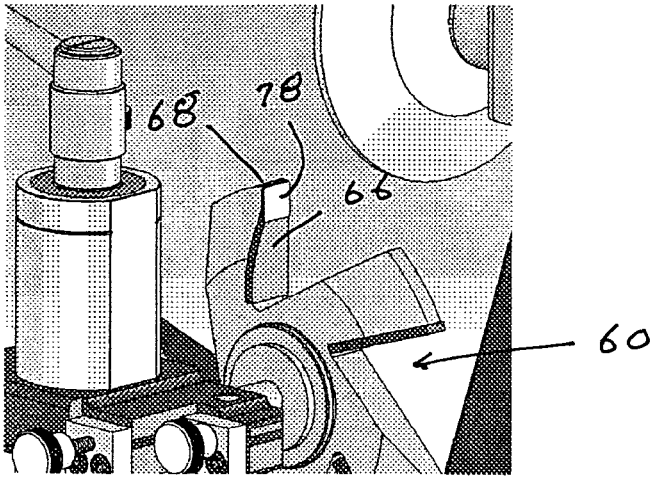
FIG. 6 is a perspective view similar to the view of FIG. 3 illustrating a step in the sharpening of a router bit in accordance with the present invention.
Figure 7:
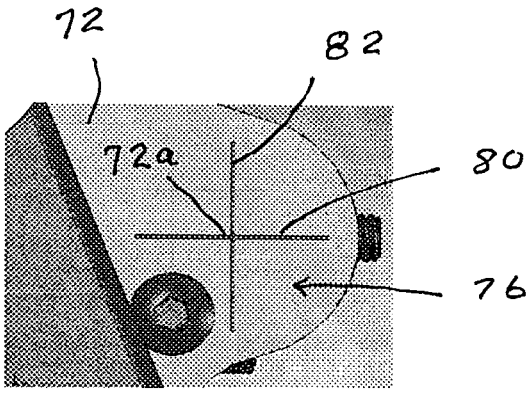
FIG. 7 is an elevation view showing further details of the apparatus of FIG.

The laser 72 is aimed in a direction parallel to the grinding wheel shaft, or perpendicular to the grinding surface 40 of the grinding wheel 38. The laser 72 is at about the same elevation as the shaft 41 of the grinding wheel 38. The laser 72 has a cross-hair target 76 (FIGS. 1 and 7) drawn at the laser beam point of origin 72*a*. The target has a horizontal line 80 drawn through the point of origin 72*a* and a vertical line 82 also drawn through the point of origin 72*a*. A mirror 78 is attached to the router bit flat face 66 as shown in FIG. 6. The mirror 78 is attached adjacent the concave cutting edge 68. The mirror 78 is affixed to a magnet (not shown) that holds the mirror 78 on to the bit flat face 66.

The tool holder 28 is adjusted vertically on vertical post 26 (by visual observation) so that the bottom edge of the bit flat face 66 is at about the same elevation as the bottom edge of the grinding wheel. Tool holder stop 30*a* or 32*a* is set to assure that the depth at which the router shank is inserted in the tool holder is the same for all the blades. The carriage 22 is moved towards the grinding wheel 38 until the laser beam hits the mirror 78. The bit 60 is rotated in the tool holder 28 until the reflected beam hits the horizontal line 80. This verifies that the bit flat face is in a plane that has the same orientation with respect to the vertical as the plane of the grinding surface of the grinding wheel. The post 26 is then rotated until the reflected beam hits the target vertical line 82. This verifies that the bit flat face is in a plane that is parallel to the plane of the grinding face of the grinding wheel. These two adjustments orient the surface to be sharpened so that the bit flat face 66 is accurately aligned with the grinding wheel flat grinding surface 40.

Operation of the sharpening device of the present invention is as follows.

A router bit is placed in either holder member 30 or 32 depending on the diameter of the bit shaft. The depth of the bit shaft in either holder member 30 or holder member 32 is set by turning adjustable stop 30*a* or adjustable stop 32*a*. The stops are set so that the entire bit surface to be ground engages the grinding face 40 of the grinding wheel 38. Once positioned in a holder member, the holder member is clamped onto the bit shank by turning tool holder clamp 28*a*. The stops 30*a* and 32*a* allow the bit shaft to be quickly repositioned in the holder member 30 or 32 when rotating the bit to sharpen a next blade without careful positioning of the bit shaft in the holder member.

A mirror 78 (FIG. 6) is then attached to the blade surface to be sharpened, as shown in FIG. 6. The laser 72 is turned on. The reflection of the laser from the mirror is used to align the blade surface. As mentioned, vertical alignment is achieved by rotating the bit in the bit holder member 30 or 32 (FIG. 3). Once aligned, the bit chuck quick release clamp 34 is tightened. Horizontal alignment is achieved by rotating the tool post 26 clockwise or counter-clockwise. Once aligned the tool post clamp 26*b* is tightened.

At this point, the height of the bit is carefully adjusted relative to the grinding wheel 38. This is achieved by releasing the tool holder quick release clamp 28*a* (FIGS. 3 and 4) and turning threaded screw 42 (FIGS. 1 and 4) using knurled knob 44. Referring to FIG. 4, bit 60 is shown at the correct height relative to the grinding wheel 38. During the sharpening process, the carriage 18 is moved back and forth (left and right in the view of FIG. 4) by hand using handle 58. The back and forth movement is between stops 18*c* and 18*d* on rod 22*a*. This allows the grinding face 40 of the grinding wheel to engage the full flat cutting face 66 of the bit 60. The bottom of the bit flat face 66 is essentially at the same level as the bottom of the grinding wheel 38. Once the tool holder and the bit are set at the desired height, the tool holder 28 is clamped onto tool post 26 using the quick release clamp 26*b*.

In the process of adjusting the height of the tool holder 28, it is important to set the stops 18*c* and 18*d*. The stops are set so that the left movement of the carriage 18, in the view of FIG. 4, up to stop 18*d*, brings the bottom of the bit face 66 into about vertical alignment with the grinding wheel shaft 41, and the right movement of the carriage 18 up to stop 18*c* brings the top of the bit face 66 into about horizontal alignment with the grinding wheel shaft 41. This assures that the bit flat face 66 never disengages from the grinding surface 40 of the grinding wheel 38.

To sharpen a bit cutting face, the operator turns on the grinding wheel motor 39. The bit 60 is moved toward the grinding wheel 38 until it engages the wheel. The operator notes the position of the knob 56 (on the dial 52) with respect to the indicator 59. The operator then continues to turn the dial 52, one line at a time, using knob 56. With each advance of the bit cutting face, the operator quickly moves the carriage 22 to the left to stop 18*d* and then to the right to stop 18*c*. The indexing is such that with each advance of the cutting bit face, one quarter of a thousandth of an inch is removed from the carbide face 66 of the cutting bit 60. Normally, turning the dial 52 a full rotation (about 40 swipes) achieves full sharpening. At this point, the operator can make five or six quick passes of the carriage 18 between stops 18*a* and 18*b* to polish the carbide face 66 of the bit 60.

Once the first blade is sharpened, the operator loosens the tool holder clamp 28*a* and repeats the steps of; vertically aligning the surface to be sharpened by rotating the bit 60 in the bit holder member 30 or 32; clamping the bit in the holder member 30 or 32; horizontally aligning the surface to be sharpened by rotating the tool post 26; clamping the tool post 26 to the tool post support 20; adjusting the height of the tool holder including setting the stops 18*c* and 18*d*; and then grinding the surface to be ground by advancing the bit 60 up to the grinding wheel 38 and carrying out the multiple passes by moving carriage 22 as with the first blade. With the machine of the present invention, sharpening can be done quickly. For instance, sharpening a two-fluted bit may take about eight minutes.

From the above description of the present invention, those skilled in the art will perceive improvements, modifications and changes. Such improvements, modifications and changes within the skill of the art are intended to be covered by the appended claims.

What is claimed is:

1. A sharpening apparatus for sharpening a cutting bit comprising a sharpening member, a laser generating a laser beam, a target at the point of origin of the laser beam, a reflecting surface on the cutting bit surface to be sharpened, and means directing said laser beam at said reflecting surface, wherein reflection from said surface onto said target accurately positions the cutting bit surface to be sharpened with respect to said sharpening member.

2. The sharpening apparatus of claim 1, said target comprising cross hairs for both vertical and horizontal adjustment of the cutting bit surface to be sharpened.

3. A sharpening apparatus for a cutting bit having a flat face comprising;

a. a grinding wheel having a shaft and a flat annular grinding surface perpendicular to said shaft;

b. a bit holder adaptable to hold said cutting bit and to orient the bit flat face into a plane that is parallel to the plane of the grinding wheel grinding surface;

c. a carriage supporting the bit holder;

d. advancing means for advancing said carriage in a motion parallel to the grinding wheel shaft so that the bit is against the grinding wheel grinding surface;

e. means for side-to-side movement of said carriage in a motion perpendicular to the grinding wheel shaft;

f. said advancing means comprising a gear train for further advancing the bit flat face against the grinding wheel grinding surface in small increments to remove small layers of material from said bit cutting face during said side-to-side movement.

4. The sharpening apparatus of claim 3 wherein said advancing means is adaptable to withdraw the cutting bit flat face away from the grinding wheel grinding face in a motion that is parallel to the grinding wheel shaft.

5. The sharpening apparatus of claim 3 wherein said bit holder comprises a tool holder, the bit being rotatable in the tool holder to position the bit flat face in a plane that has the same orientation with respect to the vertical as the grinding surface of the grinding wheel, and a tool post supporting the tool holder, the tool post being rotatable about an axis parallel to the grinding surface of the grinding wheel to position the bit flat face in a plane that is parallel to the grinding surface of the grinding wheel.

6. The sharpening apparatus of claim 5 comprising a laser and target therefore, the laser and target being positioned for accurate rotation of the bit in the tool holder and accurate rotation of the tool post.

7. A sharpening apparatus of claim 6 wherein said bit is a router or shaper bit having a plurality of blades, each blade having a carbide flat face, said grinding wheel comprising an annular fine grit diamond grinding surface.

8. A method for sharpening a cutting bit using a sharpening apparatus comprising the steps of generating a laser beam, providing a reflecting surface on the cutting bit surface to be sharpened, providing a target at the point of origin of the laser beam, reflecting the laser beam from said reflecting surface back to said target to accurately position the cutting bit surface to be sharpened with respect to said sharpening apparatus, sharpening said cutting bit surface, once positioned, with said sharpening apparatus.

9. The method of claim 8 wherein said target has cross hairs and comprising the steps of accurately adjusting the position of the cutting bit surface to be sharpened both vertically and horizontally using the laser beam.

10. The method of claim 9 wherein said bit is a router or shaper bit having a plurality of blades, each blade having a carbide flat face, using a grinding wheel having an annular flat grinding surface, comprising the steps of;

a. positioning the bit in a tool holder and adjusting the bit, using said laser beam and target therefore, so that the bit flat face is in a plane that has the same orientation with respect to the vertical as the plane of the grinding surface of the grinding wheel;

b. rotating the tool holder about an axis that is parallel to the grinding surface of the grinding wheel to position the bit flat face, using said laser beam and target therefore, in a plane that is parallel to the grinding surface of the grinding wheel.

11. The method of claim 10 further comprising the step of withdrawing the bit from engagement with the grinding surface of the grinding wheel following sharpening in a motion that is perpendicular to the plane of the grinding surface of the grinding wheel.

12. A grinding apparatus for accurately grinding a flat surface to be ground comprising; a grinding tool having a grinding surface; a target; a reflecting surface indicative of the plane of the surface to be ground; means directing a laser beam onto said reflecting surface to produce a reflected beam; reflection of said reflected beam onto said target accurately orienting said surface to be ground relative to said grinding tool.

* * * * *